US007076188B2

(12) United States Patent
Askren et al.

(10) Patent No.: US 7,076,188 B2
(45) Date of Patent: Jul. 11, 2006

(54) TONER CARTRIDGE HAVING REDUCED TONER CAPACITY AND METHOD OF USING THE SAME

(75) Inventors: Benjamin Alan Askren, Lexington, KY (US); Jason Paul Hale, Richmond, KY (US); Peter Alden Bayerle, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 28 days.

(21) Appl. No.: 10/805,082

(22) Filed: Mar. 19, 2004

(65) Prior Publication Data

US 2005/0207786 A1 Sep. 22, 2005

(51) Int. Cl.
*G03G 15/04* (2006.01)

(52) U.S. Cl. ..... 399/119; 399/110; 399/111

(58) Field of Classification Search ..... 399/119, 399/110, 111, 120, 12, 13
See application file for complete search history.

(56) References Cited

U.S. PATENT DOCUMENTS

| | | | | |
|---|---|---|---|---|
| 4,766,457 | A | 8/1988 | Barker et al. | |
| 4,963,938 | A * | 10/1990 | Sonoda et al. | 399/12 |
| 5,079,591 | A | 1/1992 | Tomita et al. | |
| 5,148,223 | A | 9/1992 | Cipolla | |
| 5,426,492 | A | 6/1995 | Diehl | |
| 5,652,947 | A | 7/1997 | Izumizaki | |
| 5,659,837 | A * | 8/1997 | Jo | 399/111 |
| 5,717,973 | A * | 2/1998 | Endoh et al. | 399/29 |
| 6,029,018 | A * | 2/2000 | Rogers et al. | 399/12 |
| 6,226,477 | B1 * | 5/2001 | Kurosawa et al. | 399/111 |
| 6,292,644 | B1 * | 9/2001 | Goto et al. | 399/120 |
| 6,339,689 | B1 * | 1/2002 | Sugiura | 399/120 |
| 6,507,720 | B1 | 1/2003 | Kabumoto et al. | |
| 2002/0150405 | A1 * | 10/2002 | Tanisawa et al. | 399/120 |

FOREIGN PATENT DOCUMENTS

| | | | |
|---|---|---|---|
| JP | 59151171 | A * | 8/1984 |
| JP | 05249830 | A * | 9/1993 |

OTHER PUBLICATIONS

"HP Wins Lawsuit Over Half-full Cartridges" Sep. 12, 2003, Associated Press, Inksell Newsletter.*

* cited by examiner

*Primary Examiner*—Diego Gutierrez
*Assistant Examiner*—Travis Reis
(74) *Attorney, Agent, or Firm*—Coats and Bennett, PLLC

(57) ABSTRACT

A toner cartridge included with an image forming device when initially sent to a user. The cartridge has a limited toner capacity. The user is able to print with the small capacity cartridge upon initially receiving the image forming device. Once the toner is exhausted, a second large capacity cartridge having a greater toner capacity can replace the small capacity cartridge. The small capacity cartridge and the large capacity cartridge are constructed in a similar shape to be mounted in the same manner within the image forming device.

16 Claims, 9 Drawing Sheets

TONER CARTRIDGE HAVING REDUCED TONER CAPACITY AND METHOD OF USING THE SAME

BACKGROUND

Image forming devices include one or more replaceable cartridges that each includes toner that is transferred from the cartridge to the media sheet during the image formation process. Upon depletion of the toner, the empty cartridge is removed from the device and replaced with a new cartridge containing a fresh toner supply.

Previous image forming devices were shipped to the consumer with a first type of cartridge that contained a predetermined amount of toner. When the toner was exhausted, the consumer replaced the cartridge with an identical cartridge that contained the same predetermined amount of toner. There was no difference between the initial cartridge and the replacement cartridge.

SUMMARY

The present invention is directed to shipping an image forming device from a manufacturer to a user with one or more small capacity cartridges. The small capacity cartridge is a functional cartridge that allows the user to print images. The small capacity cartridge can be replaced with a second, large capacity cartridge that contains a larger amount of toner. Additionally, the large capacity cartridge may include additional mechanisms that are necessary due to the larger toner capacity. The small capacity and large capacity cartridges are both interchangeable within the image forming device. Shipping the small capacity cartridge from the manufacturer to the user is advantageous because the small capacity cartridge weighs less than the large capacity cartridge, and shipping charges which are based on weight are thus reduced.

In one embodiment, the small capacity cartridge and large capacity cartridges are constructed using common elements. A single manufacturing process can be established which provides for constructing both types of cartridges. Only a few additional elements and manufacturing steps are necessary between the two constructions. Combining the two manufacturing processes saves time and cost that would otherwise be necessary for additional set-up and equipment.

DETAILED DESCRIPTION

The present invention is directed to a toner cartridge included with an image forming device when initially sent to a user. The toner cartridge, herein referred to throughout as a small capacity cartridge 20, has a limited toner capacity. The user is able to print with the small capacity cartridge 20 upon initially receiving and using the image forming device 10. Once the toner is exhausted, a second cartridge type, herein referred to throughout as a large capacity cartridge 30, is used and includes a greater toner capacity than the small capacity cartridge 20. The small capacity cartridge 20 and the large capacity cartridge 30 are constructed in a similar shape to be mounted in the same manner within the image forming device 10.

Figure 1:
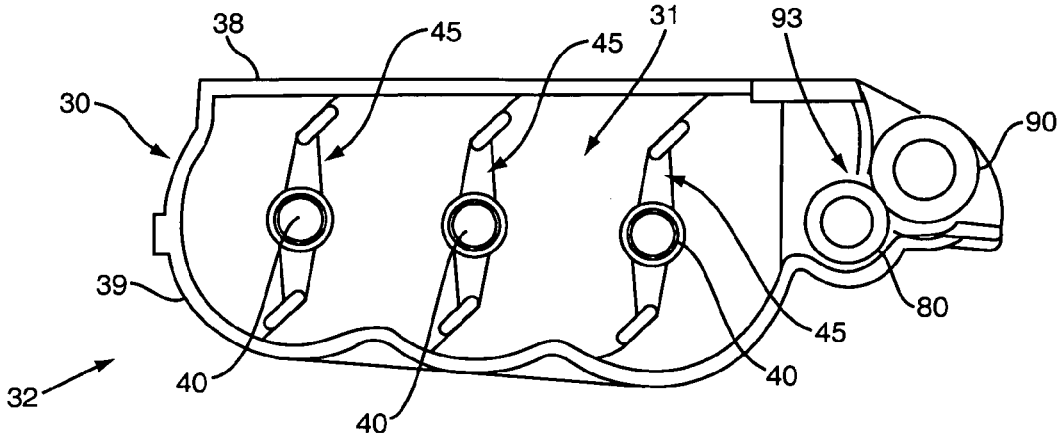
FIG. 1 is a partial cross-sectional view of a large capacity toner cartridge constructed according to one embodiment of the present invention.

FIG. 1 illustrates a large capacity cartridge 30 having a housing 32. The housing 32 defines a toner chamber 31 and a development area 93. Housing 32 may have a variety of sizes and shapes depending upon the parameters of the image forming device 10. Toner is stored throughout the toner chamber 31. Agitating members 45 are mounted on agitating mounts 40 throughout the toner chamber 31 to move the toner into the development area 93. Various numbers of agitating members 45 may be positioned within the toner chamber 31 depending upon the size and shape of the housing 32. In the embodiment of FIG. 1, three agitating members 45 move toner along the toner chamber 31 towards the development area 93. In another embodiment, housing 30 is divided into a lid 38 that mounts onto base 39.

The agitating members 45 are mounted to agitating mounts 40 within the toner chamber 31. In the embodiment illustrated in FIG. 1, agitating members 45 move the toner towards the development area 93 having a toner adder roll 80 and developer roll 90. Agitating members 45 may have a variety of configurations, and include one or more arms that extend outward from a center to sweep the toner. In one embodiment, the length of the agitating members 45 is substantially equal to the width of the toner chamber 31.

Figure 2:
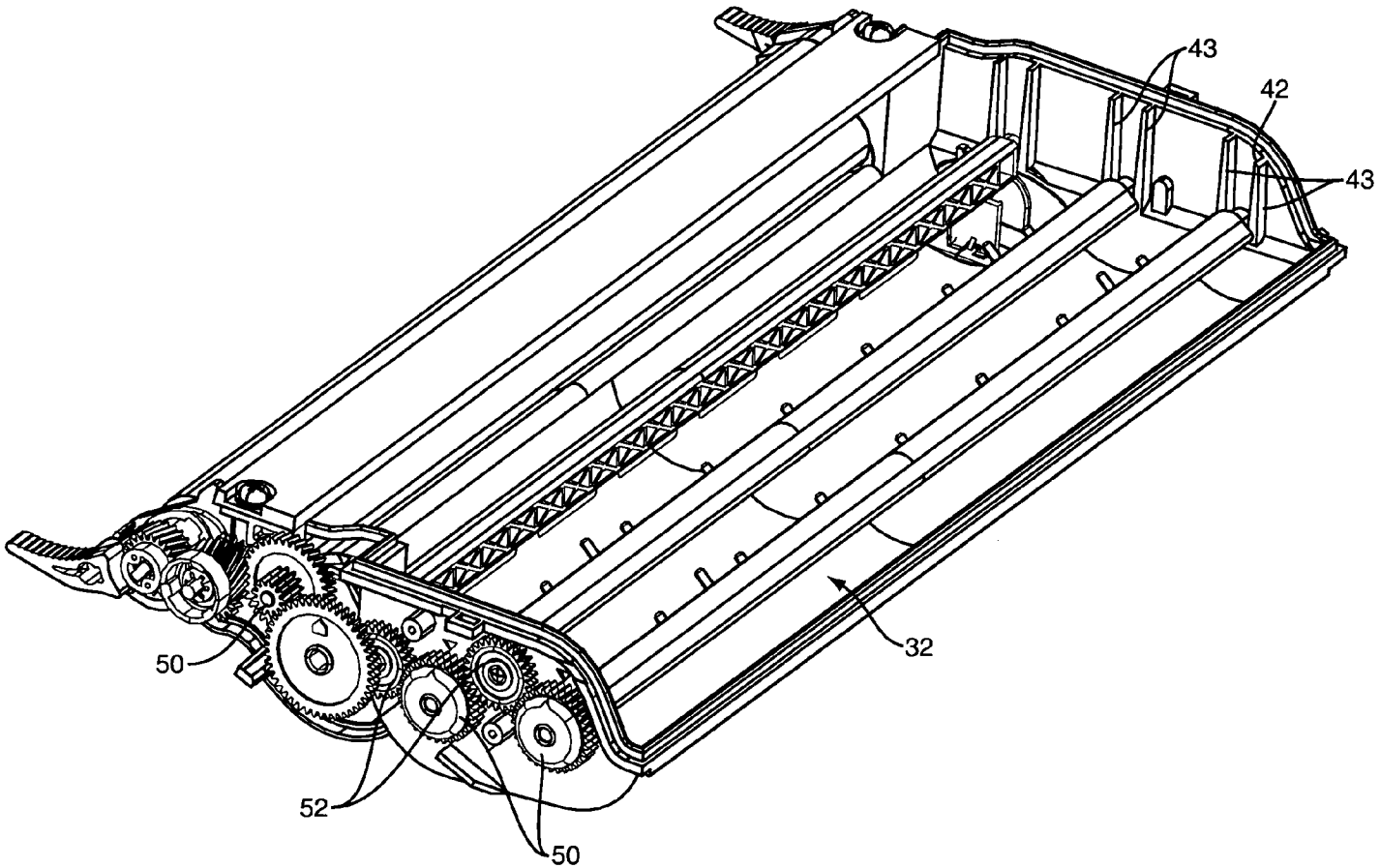
FIG. 2 is a partial perspective view of a large capacity toner cartridge constructed according to one embodiment of the present invention.

FIG. 2 illustrates a partial perspective view of the large capacity cartridge 30 featuring agitating members 45 positioned throughout the toner chamber 31. Agitating mounts 40 mount and position the agitating members 45 within the housing 32. Agitating mounts 40 may include a connection 42 extending into the interior of the housing 32 for mounting and positioning the agitating member 45. In one embodiment, connection 42 comprises a pair of spaced ribs 43 (see FIG. 2) extending inward from the interior wall of the housing 32. Gears 50 are mounted on gear receivers 44 to provide a rotational force to the agitating members 45. Connection gears 52 may span between gears 50 to synchronize the rotation of each of the agitating members 45.

Figure 3:
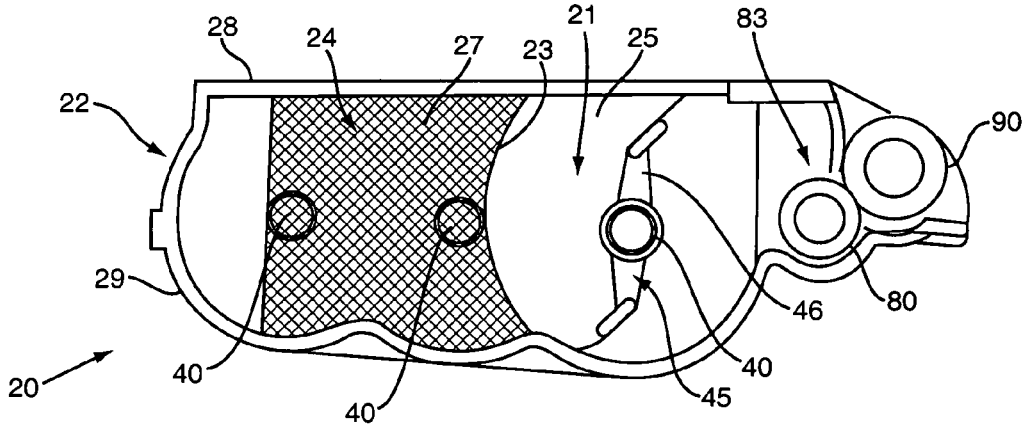
FIG. 3 is a partial cross-sectional view of a small capacity toner cartridge constructed according to one embodiment of the present invention.

FIG. 3 illustrates one embodiment of a small capacity cartridge 20. The small capacity cartridge 20 includes a housing 22 that defines a toner chamber 21 and a development area 83. A divider wall 23 extends across the toner chamber 21 forming a toner section 25 for housing toner, and a non-toner section 24. Divider wall 23 extends across the toner chamber 21 and prevents toner from escaping from the toner section 25 to the non-toner section 24. In one embodiment, housing 22 is a unitary member. In another embodiment, housing 22 is divided into a lid 28 that mounts onto a base 29.

An agitating member 45 is mounted to at least one agitating mount 40 within the toner section 25. Agitating member 45 agitates and moves the toner within the toner section 25 for image formation. In the embodiment illustrated in FIG. 3, agitating member 45 moves the toner towards the development area 83 having a toner adder roll 80 and developer roll 90. Agitating member 45 may have a variety of configurations, and include one or more arms 46 that extend outward to sweep the toner from the toner section 24. In one embodiment, the length of the agitating member 45 is substantially equal to the width of the toner chamber 21.

Figure 4:
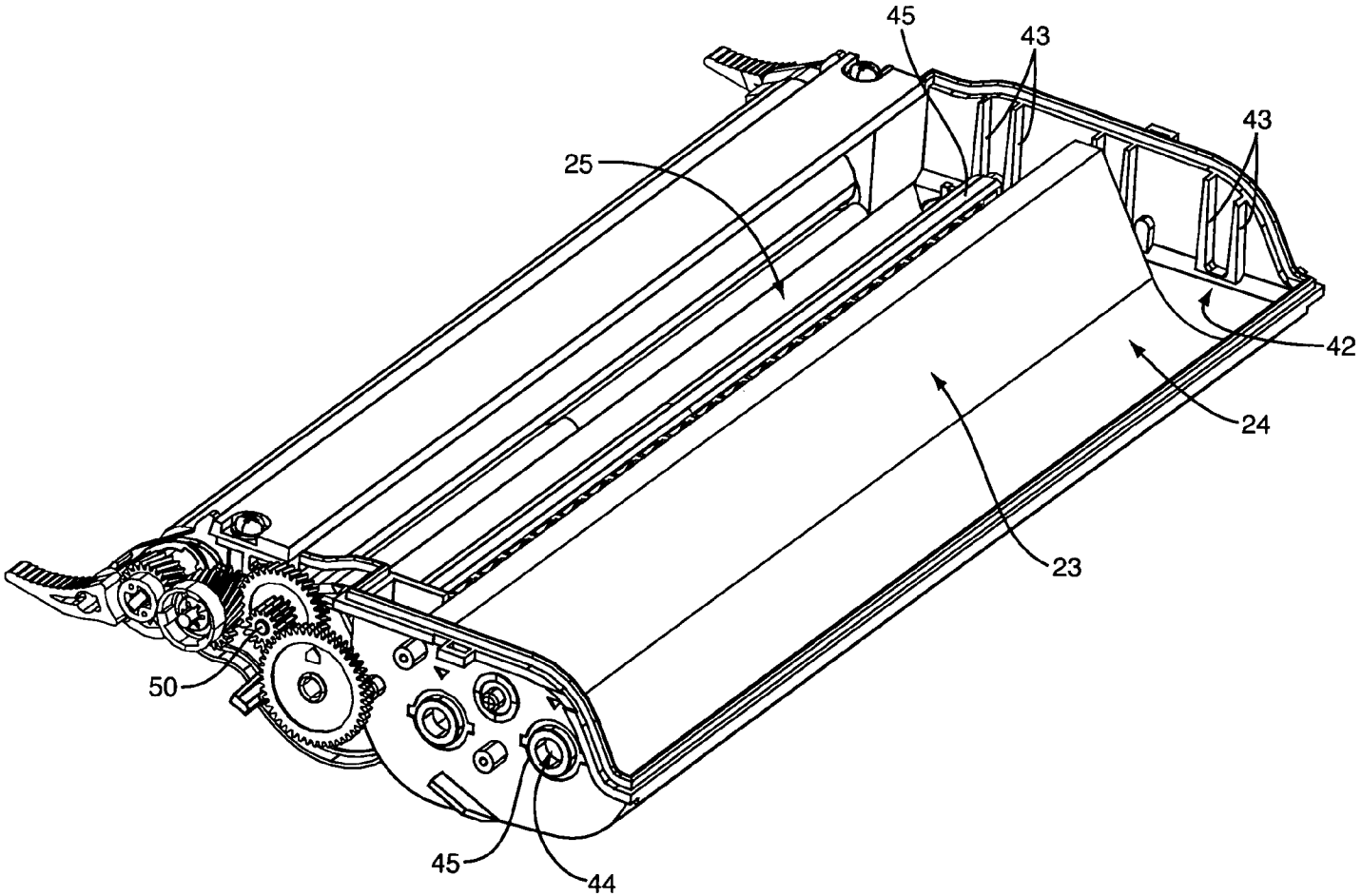
FIG. 4 is a partial perspective view of a small capacity toner cartridge constructed according to one embodiment of the present invention.

FIG. 4 illustrates a partial perspective view of the housing 22 with the lid 28 removed for clarity. Agitating gear 50 is positioned on the agitating mount 40 for rotating the agitating member 45 within the toner section 25. The two agitating mounts 40 in the non-toner section 24 are not utilized as there is no need for an agitating member 45 when there is no toner within the section. The divider wall 23 extends between a lower surface of the base 29 and the lid 28. In this embodiment, the divider wall 23 also acts as a brace to prevent the housing 22 from being compressed which may occur such as if the small capacity cartridge 20 were dropped.

The divider wall 23 extends within the toner chamber 21 to prevent toner from passing from the toner section 25 to the non-toner section 24. The divider wall 23 may have a variety of shapes and sizes depending upon the configuration of the toner chamber 21. In the embodiment illustrated in FIGS. 3 and 4, the divider wall 23 has a curved orientation corresponding to the rotational dimensions of the agitating member 45. In one embodiment, the divider wall 23 is separately constructed from the housing 22. The housing 22 is constructed in a first process, and the divider wall 23 is inserted thereafter.

In one embodiment, agitating mounts 40 comprise gear receivers 44 for receiving gears 50 that rotate the agitating member 45. The gear receivers 44 may further include a neck 45 extending outward from an exterior surface of the housing 22 with the raised neck 45 positioned around an aperture in the wall of the housing 22. In the embodiment illustrated in FIG. 3, one agitating mount 40 is positioned within the toner section 25, and two agitating mounts 40 are positioned in the non-toner section 24. The agitating mounts 40 within the non-toner section 24 are open (i.e., do not include agitating members 45).

A maximum toner capacity of the toner chamber 31 in the large capacity cartridge 30 is greater than the maximum toner capacity of the toner chamber 21 of the small capacity cartridge 20. The amount of toner within the toner chamber 21 of the small capacity cartridge 20 is limited to the toner section 25, while the amount of toner within the large capacity cartridge 30 extends over the entire toner chamber 31. In one embodiment, the maximum toner capacity of the large capacity cartridge is about twice that of the small capacity cartridge 20. In one embodiment, the maximum toner capacity of the large capacity cartridge is about 67% greater. In one embodiment, the maximum toner capacity of the small capacity cartridge 20 is about 100 grams of toner and the maximum toner capacity of the large capacity cartridge 30 is about 300 grams of toner.

The of the shape small capacity cartridge housing 22 and the large capacity housing 32 are substantially similar to allow for each cartridge to be mounted within the image forming device 10. In one embodiment, the housings 22, 32 are identical with the only differences being in the addition of the divider wall 23 within the small capacity cartridge housing 22, and the additional agitating members 45 and agitating gears 50. The same manufacturing process can be utilized to make both housings 22, 32 and can then be manipulated as necessary to complete either the small capacity toner cartridge 20 or the large capacity cartridge 30.

Figure 5:
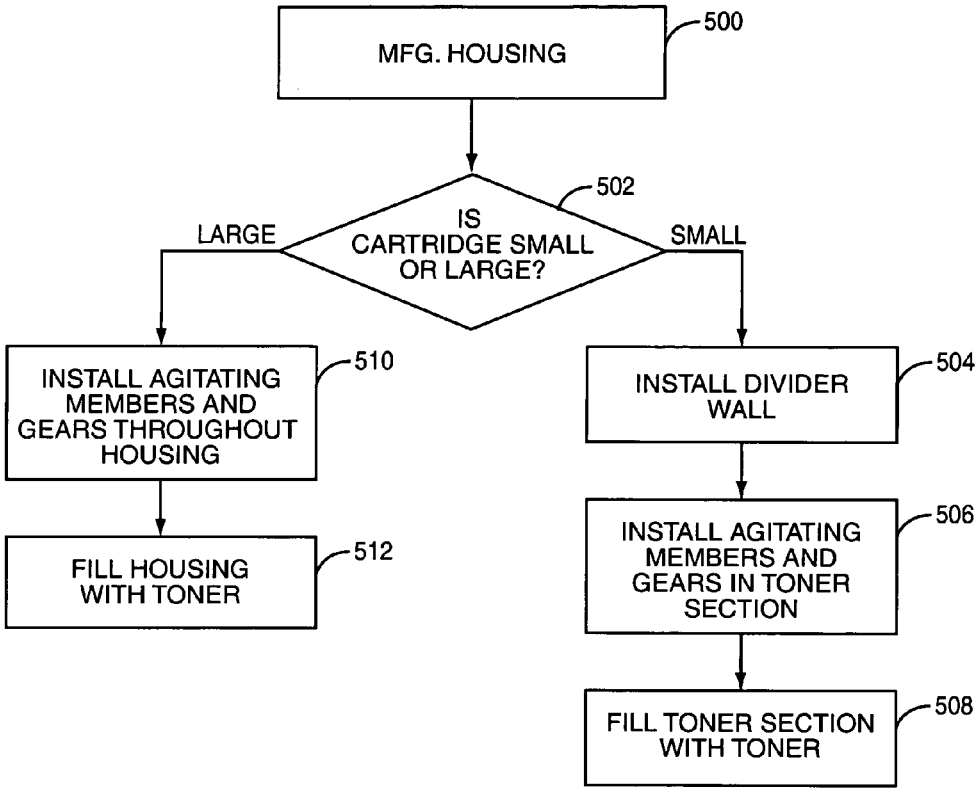
FIG. 5 is a flowchart diagram of a method of manufacturing small capacity toner cartridges and large capacity toner cartridges according to one embodiment of the present invention.

FIG. 5 illustrates one embodiment of manufacturing the toner cartridges 20, 30. The housings are manufactured in a manner that can accommodate both small capacity and large capacity cartridges 20, 30 (step 500). In one embodiment, the housings are constructed from a single molding process. Using a common housing eases the manufacturing burden as only a single manufacturing set-up and process is necessary, and the common housings can be inventoried for later use in either small capacity cartridges 20 or large capacity cartridges 30.

Once the housings are constructed, it is then determined whether to make a small capacity cartridge 20 or a large capacity cartridge 30 (step 502). For the small capacity cartridge 20, the divider wall is installed (step 504) within the toner chamber 21 to form the toner section 25 and the non-toner section 24. In one embodiment, seals are positioned between the divider wall 23 and the interior of the housing to prevent toner leakage. One or more agitating members 45 are placed within the toner section 25 and the corresponding gears 50 (step 506), and then toner is placed within the toner section 25 (step 508).

The large capacity toner cartridges 30 include installing agitating members 45 and corresponding gears 50 throughout the toner chamber 31 (step 510) and toner is placed within the housing (step 512). The number of agitating members 45 and gears 50 depends upon the shape and size of the toner chamber 31.

In another embodiment, the developer housings 22, 32 are from different manufacturing processes. The large capacity housing 32 is the same as described earlier, but the small capacity housing 22 has an integrated divider. The top of the integrated divider has a weld rib feature that attaches and seals the lid 28 to the base 29. By integrating the weld rib into the divider wall 23, the additional seals are not necessary.

Figure 6:
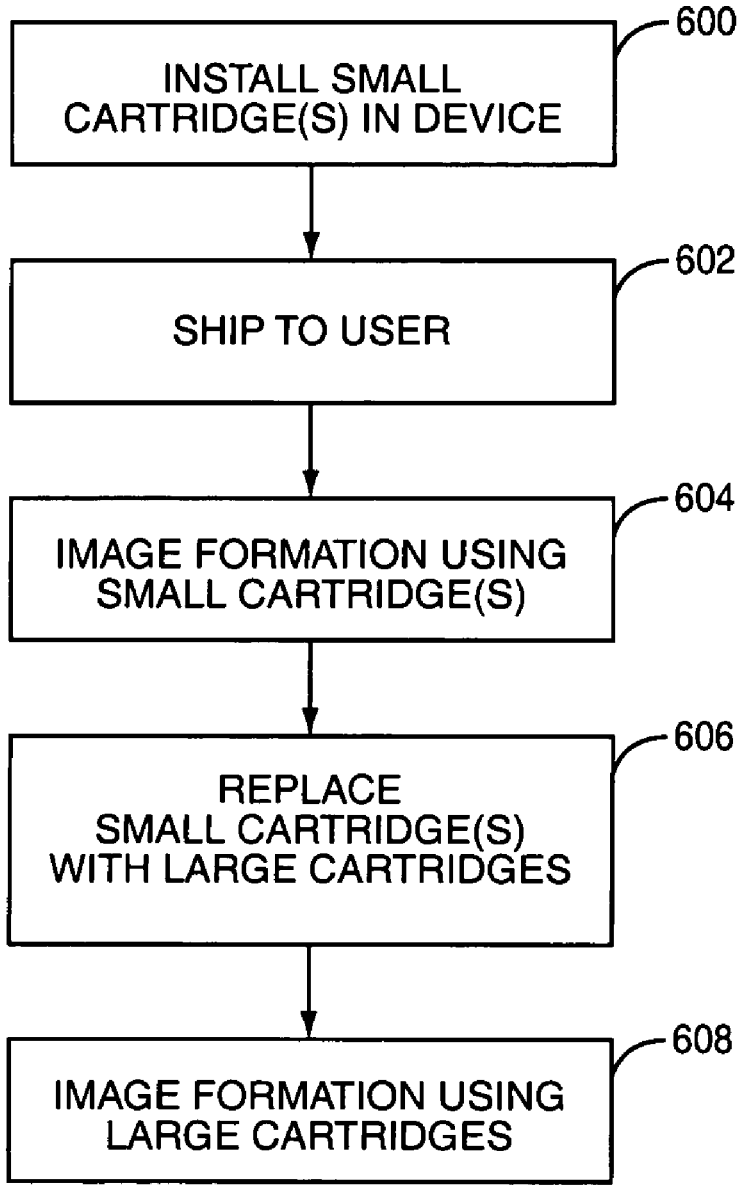
FIG. 6 is a flowchart diagram of a method of using an small capacity toner cartridge and an large capacity toner cartridge within an image forming device according to one embodiment of the present invention.

FIG. 6 illustrates the steps of using the small capacity cartridges 20 and large capacity cartridges 30 within the image forming device 10. Small capacity cartridges 20 are placed within the device 10 upon initial construction (step 600). In one embodiment, each cartridge in the device 10 is an small capacity cartridge 20. In another embodiment, the device 10 is equipped with at least one of each cartridge type (i.e., both small capacity cartridges 20 and large capacity cartridges 30 are loaded in the device 10). The device 10 with one or more small capacity cartridges 20 is shipped to the user (step 602). The small capacity cartridges 20 are fully functional and the user can produce images using the device as shipped (step 604). At a time thereafter, the user replaces the small capacity cartridges 20 with large capacity cartridges (step 606). The user then can produce images using the large capacity cartridges (step 608). In one embodiment, the user replaces the small capacity cartridge 20 when the toner is exhausted. In another embodiment, the user replaces the small capacity cartridge 20 at a point prior to toner exhaustion. After replacement, image formation continues using the large capacity cartridge 30.

Figure 7:
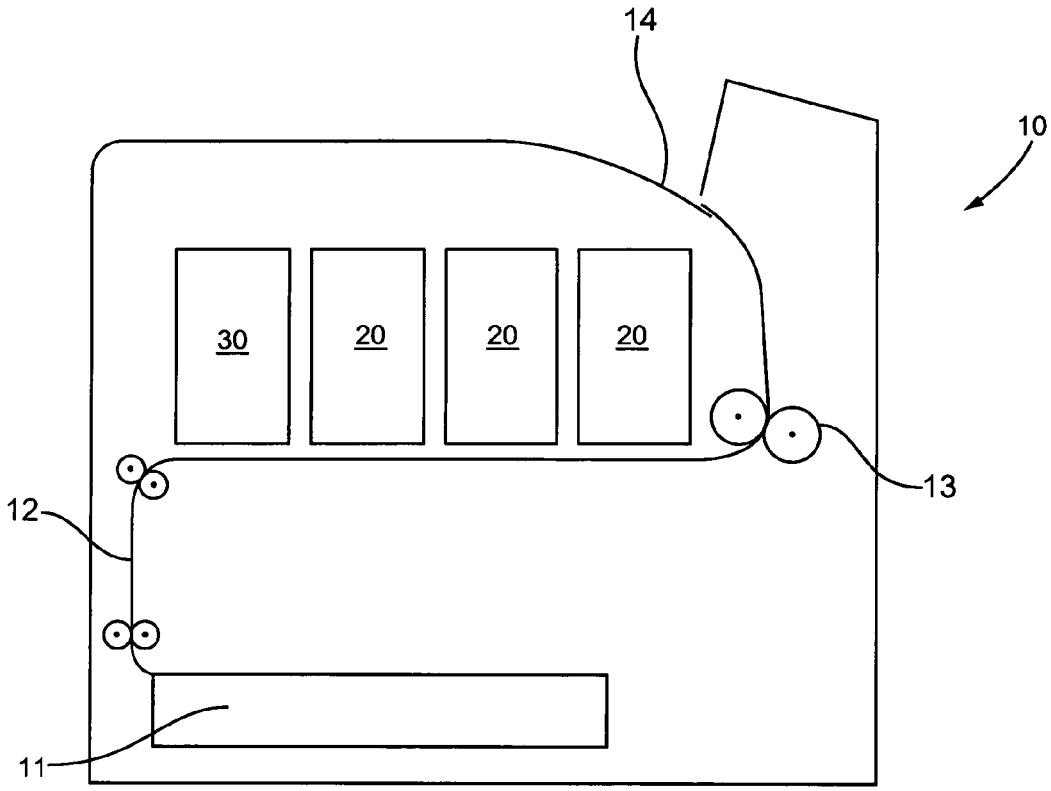
FIG. 7 is a schematic diagram of an image forming device having both small capacity and large capacity toner cartridges according to one embodiment of the present invention.

FIG. 7 illustrates a schematic view of an image forming device 10 having a plurality of toner cartridges. In the embodiment illustrated, three small capacity cartridges 20 and one large capacity cartridge 30 are installed within the device 10. In this embodiment, either the device 10 was shipped in this manner, or the one cartridge (the left-most cartridge in FIG. 7) was originally a small capacity cartridge 20 and was replaced by the large capacity cartridge 30. A media sheet stored in an input tray 11 is moved along a paper path 12 and receives a toner image from one or more of the cartridges 20, 30 to form an overall image. The media sheet with toner image moves through a fuser 13 and exits into an output tray 14. In the embodiment illustrated, four separate toner cartridges 20, 30 are mounted within the image forming device 10.

In one embodiment as illustrated in FIG. 7, the image forming device 10 forms images using four separate toner cartridges 20, 30 each equipped with a different color. In this embodiment, toner cartridges 20, 30 include black, cyan, magenta, and yellow toner.

The housing 22, 32 may have a variety of shapes and configurations. Additionally, housing 22, 32 may include a variety of different elements. In the embodiments illustrated in FIGS. 1–4, toner housings 22, 32 include a toner chamber 21, 31, and a development area 83, 93 respectively. In the embodiment illustrated, development areas 83, 93 include a toner adder roll 80 and a development roll 90. In other embodiments, the development area may include only a single roll, or may include additional elements including a photoconductive member. In one embodiment, toner housings 22, 32 only include a toner containing section and do not include the development areas 83, 93.

Divider wall 23 may be positioned at a variety of positions with the housing 22. In one embodiment, divider wall 23 is positioned with more agitating members in the toner section 25 than in the non-toner section 24. Divider wall 23 may further have a variety of shapes. In one embodiment, the wall 23 is curved to conform to the rotation of the agitating member 45. In one embodiment, divider wall 23 is substantially straight. The divider wall 23 is a rigid member that is immovable from the mounted position within the housing.

Figure 8:
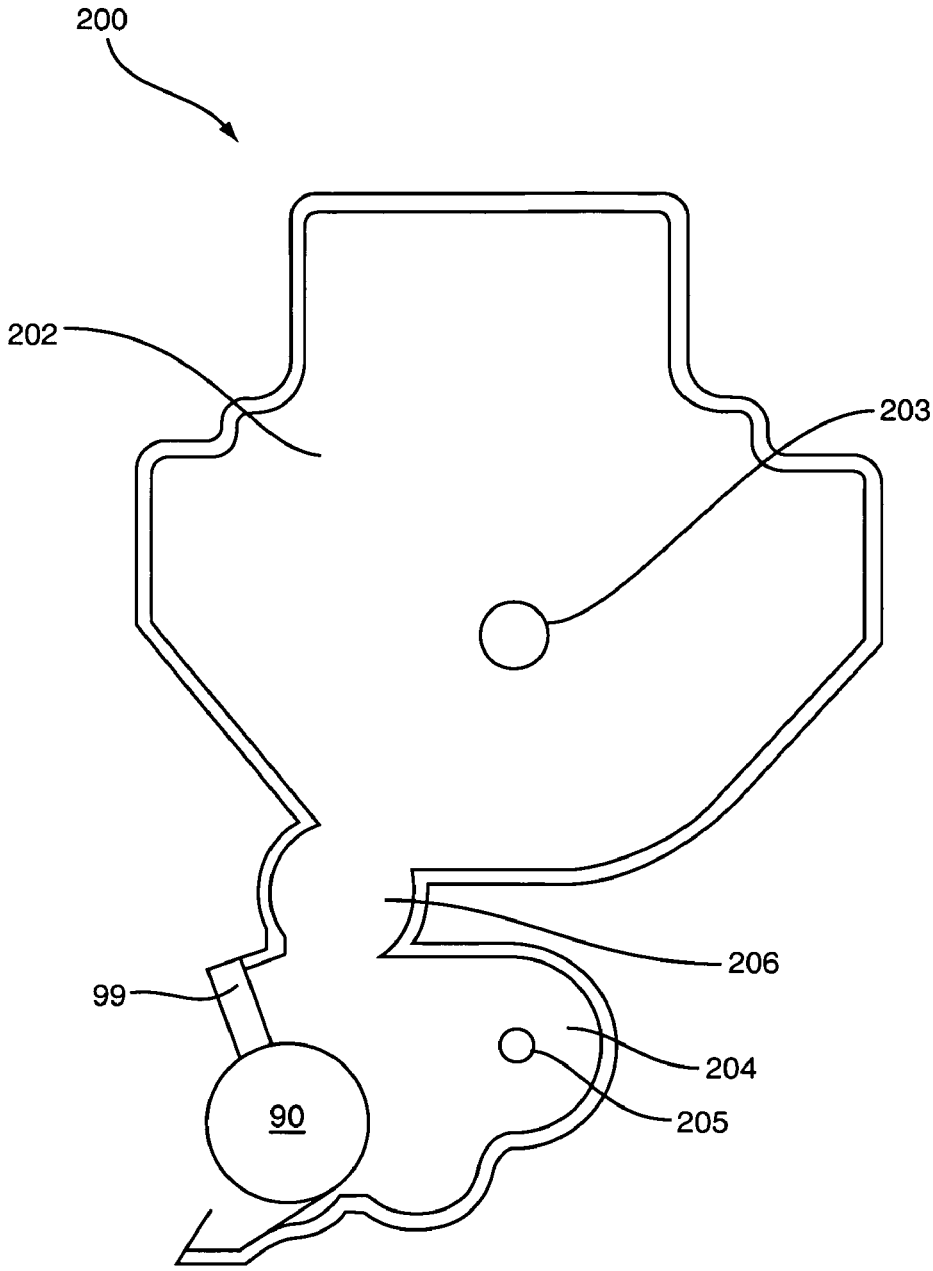
FIG. 8 is a partial cross-sectional view of a large capacity toner cartridge constructed according to one embodiment of the present invention.
Figure 9:
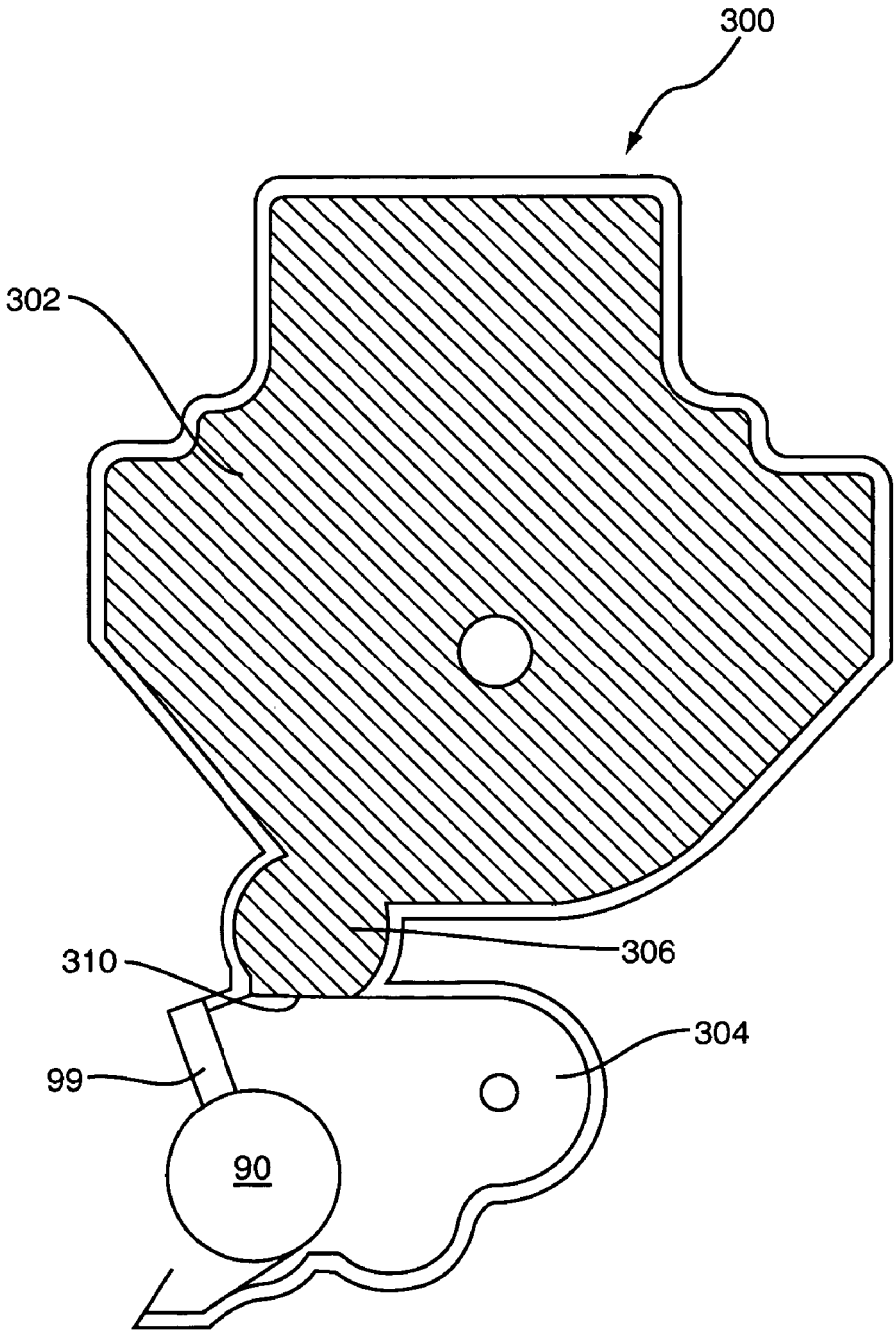
FIG. 9 is a partial cross-sectional view of a small capacity toner cartridge constructed according to one embodiment of the present invention.

FIGS. 8 and 9 illustrate another embodiment of the present invention. FIG. 8 illustrates a large capacity cartridge 200 having an upper toner reservoir 202 and a lower toner reservoir 204. An intermediate section 206 is positioned between the two reservoirs 202, 204. A valve (not illustrated) is positioned within the intermediate section 206 to move toner from the upper toner reservoir 202 to the lower toner reservoir 204. This embodiment uses gravity to feed toner from the upper toner reservoir 202 to the lower toner reservoir 204 and to be distributed by the developer roll 90. A doctor blade 99 is positioned adjacent to the developer roll 90 to control the amount of toner. Mounts 203, 205 are positioned within the upper toner reservoir 202 and lower toner reservoir 204 for mounting agitating members (not illustrated) to further assist in moving the toner.

FIG. 9 illustrates a small capacity toner cartridge 300 with toner only within the lower toner reservoir 304. Toner is not stored within the upper toner reservoir 302 or intermediate section 306. A divider wall 310 is positioned between the intermediate section 306 and lower toner reservoir 304 to prevent toner from escaping.

The term "user" is used in a broad sense herein to indicate a party that receives the image forming device after manufacturing. The "user" may include intermediaries such as a supplier or retailer, or an end user that uses the device to form images.

The term "image forming device" and the like is used generally herein as a device that produces images on a media sheet. Examples include but are not limited to a laser printer, ink-jet printer, fax machine, and copiers. One example of an image forming device is Model No. C750 available from Lexmark International, Inc. of Lexington, Ky.

The present invention is applicable for image forming device 10 having one or more cartridges. In one embodiment (not illustrated), image forming device 10 includes a single black toner cartridge for forming single-color images.

The present invention may be carried out in other specific ways than those herein set forth without departing from the scope and essential characteristics of the invention. In one embodiment, the small capacity cartridge 20 is constructed from a different manufacturing process than the large capacity cartridge 30. In this embodiment, the divider wall 23 is integrally formed within the housing 22. In one embodiment, the divider wall 23 is integrally formed with the housing. In one embodiment, non-toner section 24 is an open space. In another embodiment, a filler 27 is positioned within all or a portion of the non-toner section 24. The present embodiments are, therefore, to be considered in all respects as illustrative and not restrictive, and all changes coming within the meaning and equivalency range of the appended claims are intended to be embraced therein.

What is claimed is:

1. A method of supplying an image forming device to a user, the method comprising the steps of:

prior to first using shipping the image forming device to the user with a first cartridge having a first maximum toner capacity and a first housing having a first external shape;

forming images with the image forming device and using a divider wall that provides the toner from the first cartridge;

supplying the user with a second cartridge having a second maximum toner capacity and a second housing having a second external shape; and replacing the first cartridge with the second cartridge;

the first maximum toner capacity being less than the second maximum toner capacity;

the first external housing shape being substantially the same as the second external housing shape.

2. The method of claim 1, further comprising constructing the first housing and the second housing using a common manufacturing process.

3. The method of claim 2, further comprising using a common mold and producing the first housing and the second housing.

4. The method of claim 1, further comprising filling the second cartridge with at least twice a toner amount as the first cartridge.

5. The method of claim 1, further comprising constructing the second cartridge to have a greater weight than the first cartridge.

6. A method of manufacturing a plurality of toner cartridges comprising the steps of:

forming a plurality of identical toner cartridge housings;

forming a first toner cartridge using one of the plurality of the housings, the first toner cartridge having a first maximum toner capacity by positioning a rigid divider wall across the one of the plurality of said housings;

forming a second toner cartridge using at least another one of the housings having a second maximum toner capacity;

the first maximum toner capacity being less than the second maximum toner capacity.

7. The method of claim 6, further comprising forming the plurality of identical toner cartridge housings using a common mold.

8. The method of claim 6, further comprising shipping an image forming device with the first toner cartridge to a user.

9. The method of claim 8, further comprising using the image forming device and replacing the first toner cartridge with the second toner cartridge.

10. The method of claim 6, further comprising forming the second toner cartridge with at least 50% greater toner capacity than the first toner cartridge.

11. The method of claim 6, further comprising attaching a greater number of agitating members to the second toner cartridge than to the first toner cartridge.

12. The method of claim 11, further comprising attaching a greater number of gears to the second toner cartridge than to the first toner cartridge.

13. A method of manufacturing a plurality of toner cartridges comprising:

forming a plurality of substantially identical toner cartridge housing;

forming a first toner cartridge using one of the plurality of housings, the toner cartridge having a space capable of holding toner and a wall dividing that space to define a first toner area having a first maximum toner capacity;

forming a second toner cartridge using another one of the housings having a space capable of holding toner substantially the same as the space in the first cartridge without the dividing wall to define a second toner area having a second maximum capacity.

14. The method of claim 13, further comprising forming the plurality of identical toner cartridge housings using a common mold.

15. The method of claim 14, further comprising attaching a greater number of agitating members to the second toner cartridge than to the first toner cartridge.

16. The method of claim 15, further comprising attaching a greater number of gears to the second toner cartridge than to the first toner cartridge.

* * * * *